US007918706B2

(12) United States Patent
Cole

(10) Patent No.: US 7,918,706 B2
(45) Date of Patent: Apr. 5, 2011

(54) MESOTUBE BURN-IN MANIFOLD

(75) Inventor: Barrett E. Cole, Bloomington, MN (US)

(73) Assignee: Honeywell International Inc., Morristown, NJ (US)

( * ) Notice: Subject to any disclaimer, the term of this patent is extended or adjusted under 35 U.S.C. 154(b) by 923 days.

(21) Appl. No.: 11/807,561

(22) Filed: May 29, 2007

(65) Prior Publication Data

US 2008/0298934 A1 Dec. 4, 2008

(51) Int. Cl.
*H01J 9/38* (2006.01)

(52) U.S. Cl. ..... 445/70

(58) Field of Classification Search ..... 445/70–73, 445/38; 222/326
See application file for complete search history.

(56) References Cited

U.S. PATENT DOCUMENTS

| | | | | |
|---|---|---|---|---|
| 4,665,740 | A | 5/1987 | Matsumoto et al. | |
| 5,371,435 | A | 12/1994 | Ohishi et al. | |
| 5,443,416 | A | 8/1995 | Volodarsky et al. | |
| 5,763,888 | A | 6/1998 | Glasheen et al. | |
| 5,898,377 | A | 4/1999 | Adachi | |
| 5,929,450 | A | 7/1999 | Glasheen et al. | |
| 5,941,699 | A | 8/1999 | Abele | |
| 6,171,513 | B1 | 1/2001 | Davis et al. | |
| 6,344,414 | B1 | 2/2002 | Davis et al. | |
| 6,780,378 | B2 | 8/2004 | Abbasi et al. | |
| 6,784,430 | B2 | 8/2004 | Matocha et al. | |
| 6,824,456 | B2 * | 11/2004 | Ebner et al. | 451/287 |
| 7,202,794 | B2 | 4/2007 | Huseynov et al. | |
| 7,244,946 | B2 | 7/2007 | Burnette et al. | |
| 7,456,412 | B2 | 11/2008 | Cole et al. | |
| 2003/0019812 | A1 * | 1/2003 | Berger et al. | 210/656 |
| 2007/0132050 | A1 | 6/2007 | Sumiya et al. | |

FOREIGN PATENT DOCUMENTS

EP 1 193 031 A1 4/2002

OTHER PUBLICATIONS

EP Search Report for EP application No. 08157006.1 dated Dec. 28, 2010.

* cited by examiner

*Primary Examiner* — Joseph L Williams
*Assistant Examiner* — Brenitra M Lee
(74) *Attorney, Agent, or Firm* — Kermit D. Lopez; Luis M. Ortiz; Kris T. Fredrick

(57) ABSTRACT

A two chamber system with fill gas in one chamber and vacuum in the other provides a means of burning in one or more vacuum tubes while avoiding contamination from environmental gases. Vacuum tubes are often burned in after being sealed. Some processes burn-in the tubes before sealing them. The burn in process can take days and provide ample opportunity for environmental gases to contaminate the vacuum tube. The vacuum tube's fill tube passes through the vacuum chamber and into the fill gas chamber. Environmental gases leaking past the fill tube are evacuated by the vacuum. Similarly, fill gas leaking past the fill tube is also evacuated to vacuum. As such, the environmental gases are drawn away before contaminating the vacuum tube.

14 Claims, 4 Drawing Sheets

MESOTUBE BURN-IN MANIFOLD

TECHNICAL FIELD

Embodiments relate to the manufacture of flame detector tubes and vacuum tubes. Embodiments also relate to sputtering, gettering, vacuum chambers, manifolds, and process gas delivery systems.

BACKGROUND OF THE INVENTION

Vacuum tubes, the predecessors of transistors and diodes, are air tight chambers with cathodes and anodes. The air is largely evacuated from the tube, hence the name vacuum tube. The tube's cathode is held at a lower voltage than the tube's anode so that electrons are accelerated from the cathode to the anode. As electrons move to the anode, they collide with air molecules knocking even more electrons loose and thereby amplifying the number of electrons. In many tubes, the cathode is heated to produce thermionic electrons. In other tubes, photons are allowed to impact the cathode to cause the release of photoelectrons.

Vacuum tubes are rarely used in circuitry any more. They are, however, often used in light detection. Some tubes are so sensitive that a single photon can cause an electron to leave the cathode and induce a large avalanche of secondary and tertiary electrons that reach the anode. One type of photon sensitive tube is a flame detector tube. A flame detector tube is sensitive to the photons produced by flames.

In operation, a tube's anode and cathode are subjected to a constant and necessary bombardment of electrons and ions. The result is the etching and sputtering of the cathode and anode. To provide long tube life, the anode and cathode are often made from or coated with resistant materials such as tungsten and molybdenum while still being consistent with the demands for the proper work function. Similarly, the gas in the tube is chosen to be one that will not damage the anodes and cathodes too much nor react with other tube materials consistent with proper breakdown characteristics. Neon and a neon/hydrogen mix are often used as tube gasses because they are fairly light and nonreactive.

In the manufacture of vacuum tubes, a burn-in period is often required. When first produced, anodes and cathodes are rough. The rough surfaces affect the electric fields and result in inconsistent and occasionally even damaging electron flows and sputtering effects. Burn-in is a process in which the tube is run at an elevated voltage to sputter the surfaces smooth. The materials and gases used in vacuum tubes, however, are specifically chosen to minimize sputtering. Engineering decisions for extended tube life also cause long burn-in times. Some burn-in procedures must be performed before the vacuum tube is sealed. As such, there is ample opportunity for environmental gases to contaminate the inside of the vacuum tube. Systems and methods for contamination free burn-in of non-sealed vacuum tubes are needed.

BRIEF SUMMARY

The following summary is provided to facilitate an understanding of some of the innovative features unique to the embodiments and is not intended to be a full description. A full appreciation of the various aspects of the embodiments can be gained by taking the entire specification, claims, drawings, and abstract as a whole.

It is therefore an aspect of the embodiments that a burn-in manifold has a first chamber, a cavity, and a lid. The lid covers the cavity to form a second chamber. An interior wall is shared by the first chamber and the second chamber.

It is also an aspect of the embodiments that the interior wall has an interior wall opening and that the lid has an exterior opening. A vacuum tube's fill tube can reach into the first chamber by passing through the exterior opening, through the second chamber and through the interior wall opening. An exterior seal can seal the fill tube to the exterior wall to prevent environmental gas from entering the second chamber. An interior seal can seal the fill tube to the interior wall to prevent gas from passing from the first chamber into the second chamber. O rings can be used as interior seals and as exterior seals.

BRIEF DESCRIPTION OF THE DRAWINGS

The accompanying figures, in which like reference numerals refer to identical or functionally similar elements throughout the separate views and which are incorporated in and form a part of the specification, further illustrate aspects of the embodiments and, together with the background, brief summary, and detailed description serve to explain the principles of the embodiments.

DETAILED DESCRIPTION

The particular values and configurations discussed in these non-limiting examples can be varied and are cited merely to illustrate at least one embodiment and are not intended to limit the scope thereof. In general, the figures are not to scale.

A two chamber system with fill gas in one chamber and vacuum in the other provides a means of burning in one or more vacuum tubes while avoiding contamination from environmental gases. Vacuum tubes are often burned-in after being sealed. Some processes burn-in the tubes before sealing them. The burn-in process can take days and provide ample opportunity for environmental gases to contaminate the vacuum tube. The vacuum tube's fill tube passes through the vacuum chamber and into the fill gas chamber. Environmental gases leaking past the fill tube are evacuated by the vacuum. Similarly, fill gas leaking past the fill tube is also evacuated to vacuum. As such, the environmental gases are drawn away before contaminating the vacuum tube.

Figure 1:
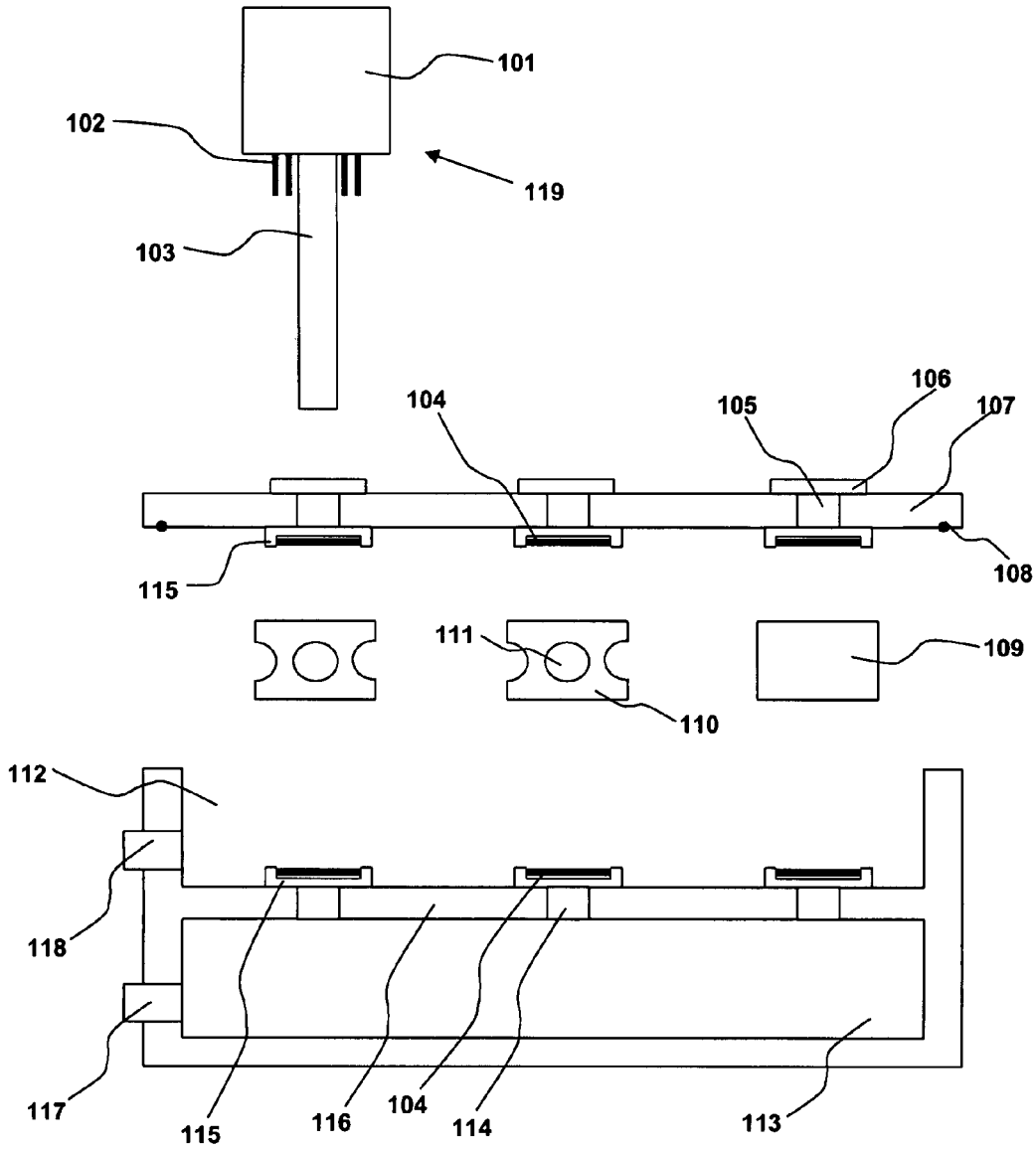
FIG. 1 illustrates a burn-in manifold with a lid in accordance with aspects of the embodiments.

FIG. 1 illustrates a burn-in manifold with a lid 107 in accordance with aspects of the embodiments. The lid 107 has exterior openings 105, burn-in connectors 106, exterior seals 104, and a gasket 108. The exterior seals can be O-rings that rest in cups 115. A manifold body has a cavity 112 and a first chamber 113 separated by an interior wall 116. The interior wall has interior wall openings 114 as well as seals 104 and cups 115. Spacer rings 109, 110 can press the seals 104 against the interior wall 116 and lid 107. A ported spacer ring 110 has ports 111 passing from the spacer ring's center to its exterior. A vacuum port 118 can be connected to a vacuum source while a fill port 117 can be connected to a gas source. A vacuum tube 119 has a body 101, fill tube 103 and tube connectors 102.

Figure 2:
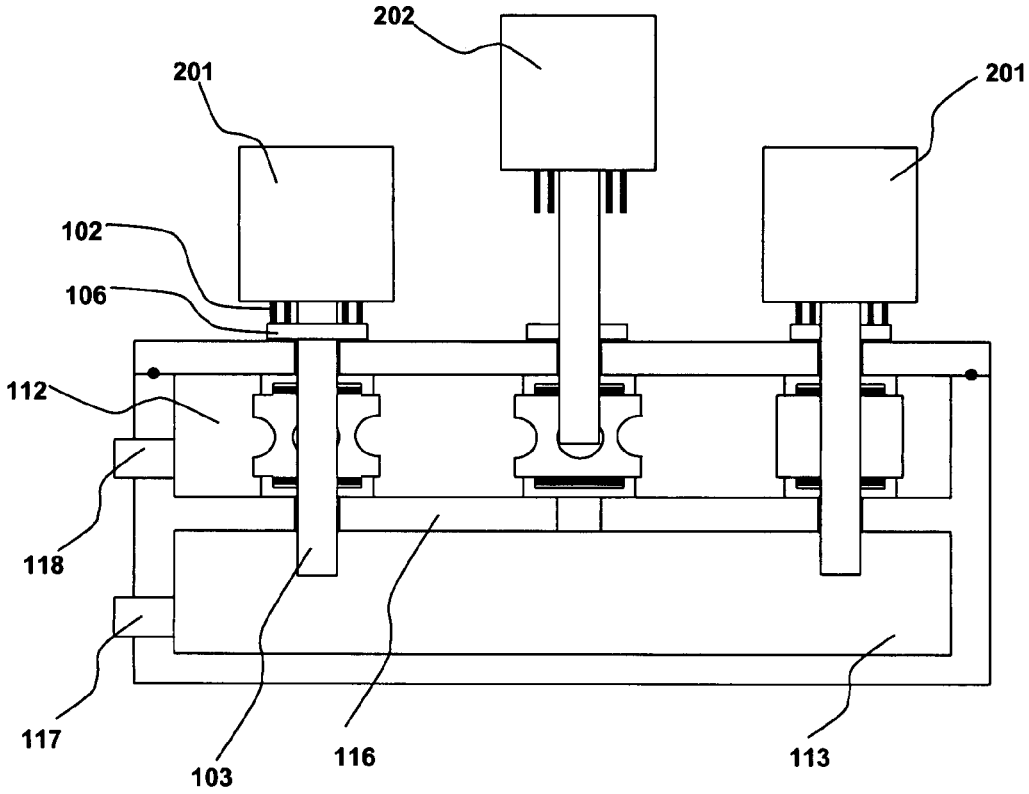
FIG. 2 illustrates a burn-in manifold with a lid and installed vacuum tubes in accordance with aspects of the embodiments.

FIG. 2 illustrates a burn-in manifold with a lid 107 and installed vacuum tubes 201, 202 in accordance with aspects of the embodiments. The burn-in manifold of FIG. 2 is the same as that of FIG. 1 with the exception that the lid 107 and spacer rings are installed. Vacuum tubes 201 have been pressed through the exterior openings, through the spacer rings, through the interior openings, and into the first chamber. A fill gas in the first chamber 113 will pass into the vacuum tubes 201. Fill gas leaking through the interior openings will be evacuated out the vacuum port 118 and will not pass into the outside atmosphere. Similarly, environmental gases leaking through the exterior openings will be evacuated to vacuum and will not enter the first chamber 113. This is particularly important because otherwise a single bad seal could contaminate every vacuum tube. The vacuum tubes 201 have their tube connectors 102 mated to the lid's burn-in connectors. As such, the tubes can be burned-in.

One vacuum tube 202 is illustrated as pressed into a ported spacer ring. The fill tube is exposed to vacuum such that environmental gas is evacuated from the vacuum tube and out the vacuum port 118.

The interior seals and exterior seals minimize the leakage of gases, but can not be trusted to completely prevent all leakage for the entire time that the vacuum tubes burn-in. A burn-in manifold designed for a single tube at a time benefits from the dual chamber arrangement because otherwise it would depend on a single seal and no vacuum evacuation. The dual chamber arrangement is particularly advantageous for a multiple tube manifold such as those illustrated. The reason is a single chamber manifold system contaminates all the vacuum tubes when a single seal fails. Furthermore, single seal failures can easily occur during an entire burn-in cycle. The dual chamber arrangement is resistant to contamination because it is designed to work properly in spite of less than perfect seals.

Figure 3:
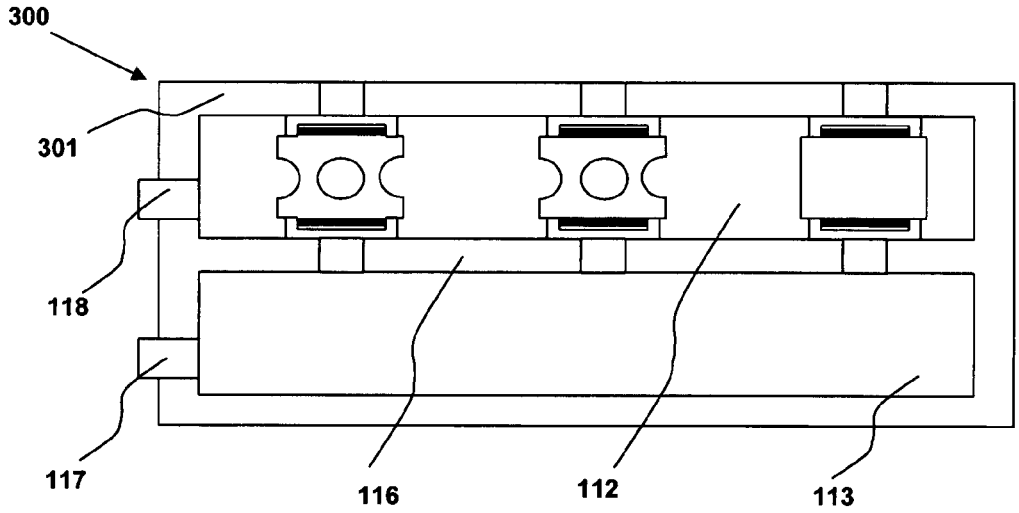
FIG. 3 illustrates a burn-in manifold in accordance with aspects of the embodiments.

FIG. 3 illustrates a burn-in manifold 300 in accordance with aspects of the embodiments. The burn-in manifold of FIG. 3 is the same as that of FIG. 2 with the exception of having no lid. Instead of a lid, the burn-in manifold 300 has a permanent exterior wall 301. Like the lid, the exterior wall 301 has exterior openings, seals, and cups.

Figure 4:
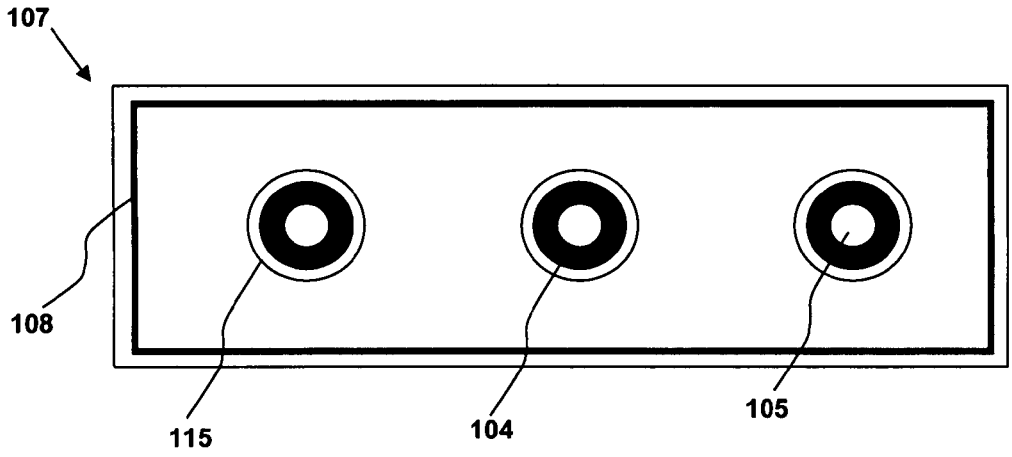
FIG. 4 illustrates a burn-in manifold lid in accordance with aspects of the embodiments.

FIG. 4 illustrates a burn-in manifold lid 107 in accordance with aspects of the embodiments. The lid 107 has a gasket 108, exterior openings 105, seals 104, cups 115, and gasket 108.

Figure 5:
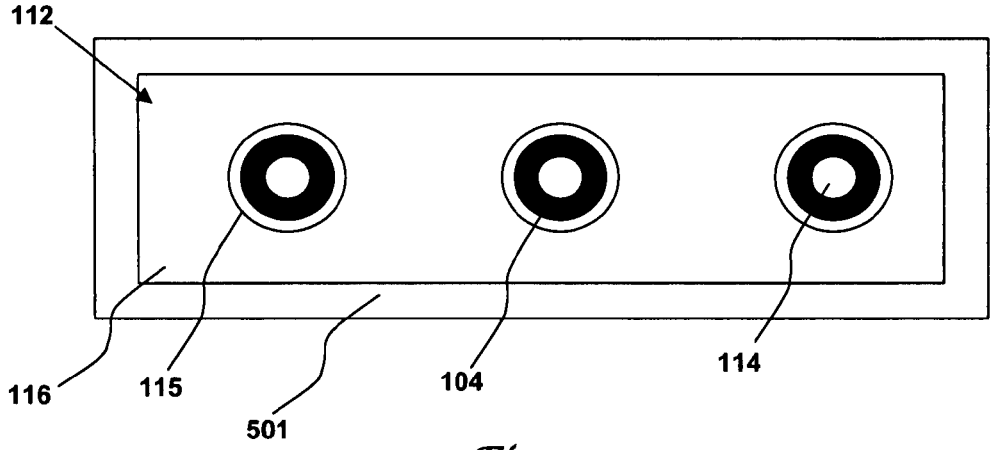
FIG. 5 illustrates a burn-in manifold cavity in accordance with aspects of the embodiments.

FIG. 5 illustrates a burn-in manifold cavity in accordance with aspects of the embodiments. The cavity 112 is surrounded by cavity walls 501 with the interior wall 116 forming the cavity 112 bottom. The interior wall 116 has interior openings 114, seals 104, cups 115, and gasket 108.

Figure 6:
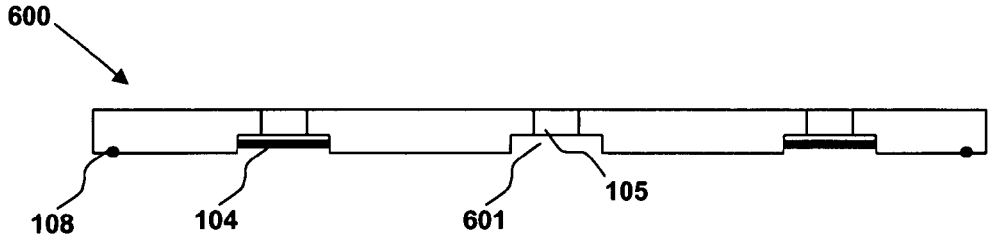
FIG. 6 illustrates a cut view of a burn-in manifold lid in accordance with aspects of the embodiments.

FIG. 6 illustrates a cut view of a lid 600 with recessed cups 601 in accordance with aspects of the embodiments. As with the lids in other figures, the lid 600 has exterior openings 105, a gasket 108, and seals 104. A recessed cup 601 can hold a seal 104 such as on O-rinq and can be less expensive to produce.

Figure 7:
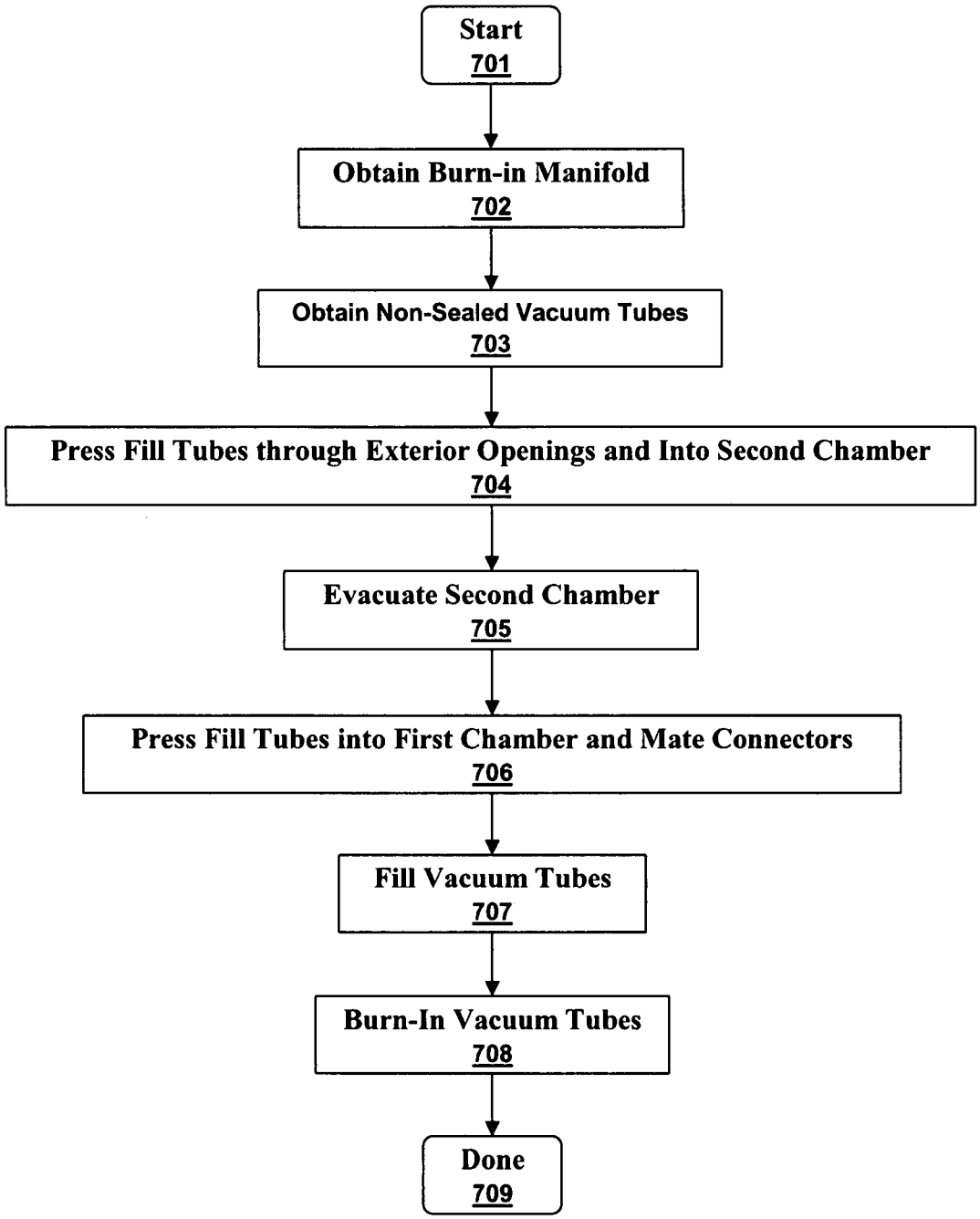
FIG. 7 illustrates high level flow diagram of using a burn-in manifold in accordance with aspects of the embodiments.

FIG. 7 illustrates high level flow diagram of using a burn-in manifold in accordance with aspects of the embodiments. After the start 701 a burn-in manifold is obtained 702 and vacuum tubes are obtained 703. The vacuum tubes' fill tubes are pressed through the manifolds exterior openings such that they reach into the spacer rings but not into the interior openings 705. The second chamber is evacuated 705 which also evacuates the vacuum tubes. The fill tubes are then pressed through the interior openings such that the tube connectors and burn-in connectors mate 706. Fill gas is passed into the first chamber such that the vacuum tubes are filled 707 and then the vacuum tubes are burned-in 708. The burn-in process is done 709 and the vacuum tubes can be sealed and packaged for sale.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The embodiments of the invention in which an exclusive property or right is claimed are defined as follows.

Having thus described the invention what is claimed is:

1. A system comprising:

a first chamber and a second chamber wherein the second chamber comprises an outside wall and wherein the first chamber and the second chamber share an interior wall;

a vacuum port in the second chamber and a fill port in the first chamber;

an interior wall opening in the interior wall; and an exterior opening in the exterior wall;

a burn in connector, wherein a vacuum tube comprises a body, a tube connector, and a fill tube, and wherein the tube connector mates to the burn in connector when the fill tube reaches into the first chamber;

wherein the fill tube reaches into the first chamber by passing through the exterior opening, through the second chamber and through the interior wall opening;

wherein an exterior seal seals the fill tube to the exterior wall; and wherein an interior seal seals the fill tube to the interior wall.

2. The system of claim 1 wherein the exterior seals and the interior seals are O rings.

3. The system of claim 1 further comprising a spacer ring positioned within the first chamber such that a fill tube reaches into the second chamber by passing through the exterior opening, through the spacer ring and through the interior wall opening.

4. The system of claim 3 wherein the spacer ring is a ported spacer ring.

5. The system of claim 1 further comprising a spacer ring positioned within the first chamber such that a fill tube reaches into the second chamber by passing through the exterior opening, through the spacer ring and through the interior wall opening.

6. The system of claim 5 wherein the spacer ring is a ported spacer ring.

7. A system comprising:

a first chamber, a cavity, and a lid wherein the lid covers the cavity to form a second chamber and wherein the first chamber and the second chamber share an interior wall;

a vacuum port in the second chamber and a fill port in the first chamber;

an interior wall opening in the interior wall; and an exterior opening in the lid;

a burn in connector, wherein a vacuum tube comprises a body, a tube connector, and a fill tube, and wherein the tube connector mates to the burn in connector when the fill tube reaches into the first chamber;

wherein the fill tube reaches into the first chamber by passing through the exterior opening, through the second chamber and through the interior wall opening;

wherein an exterior seal seals the fill tube to the exterior wall; and wherein an interior seal seals the fill tube to the interior wall.

8. The system of claim 7 wherein the exterior seals and the interior seals are O rings.

9. The system of claim 8 further comprising a spacer ring positioned within the first chamber such that a fill tube reaches into the second chamber by passing through the exterior opening, through the spacer ring and through the interior wall opening.

10. The system of claim 9 wherein the spacer ring is a ported spacer ring.

11. The system of claim 7 further comprising a spacer ring positioned within the first chamber such that a fill tube reaches into the second chamber by passing through the exterior opening, through the spacer ring and through the interior wall opening.

12. The system of claim 11 wherein the spacer ring is a ported spacer ring.

13. A system comprising:

a first chamber, a second chamber, an interior seal that seals a vacuum tube to the first chamber, a burn in connector, wherein a vacuum tube comprises a body, a tube connector, and a fill tube, and wherein the tube connector mates to the burn in connector when the fill tube reaches into the first chamber, and wherein evacuating the air from the second chamber prevents air from leaking into the first chamber and also prevents air from leaking into the system.

14. The system of claim 13 further comprising at least one additional interior seal wherein a multiplicity of vacuum tubes are sealed to the first chamber.

* * * * *